United States Patent [19]

Chase

[11] Patent Number: 4,470,029

[45] Date of Patent: Sep. 4, 1984

[54] CONVERGENCE UNIT FOR IN-LINE COLOR CATHODE RAY TUBE

[75] Inventor: Brian D. Chase, Eastleigh, England

[73] Assignee: International Business Machines Corporation, Armonk, N.Y.

[21] Appl. No.: 454,397

[22] Filed: Dec. 29, 1982

[30] Foreign Application Priority Data

Mar. 31, 1982 [EP] European Pat. Off. ..... 82301683.7

[51] Int. Cl.[3] ..... H01F 7/00

[52] U.S. Cl. ..... 335/210; 313/421; 335/213

[58] Field of Search ..... 335/210, 212, 213; 313/421

[56] References Cited

U.S. PATENT DOCUMENTS 3,866,080 2/1975 Barkow ..... 313/412

FOREIGN PATENT DOCUMENTS 2571 6/1971 European Pat. Off. .

2228293 11/1974 France .

OTHER PUBLICATIONS

IBM Technical Disclosure Bulletin, vol. 24, No. 2, Jul. 1981, pp. 1061–1062.

IBM Technical Disclosure Bulletin, vol. 24, No. 2, Jul. 1981.

*Primary Examiner*—George Harris

*Attorney, Agent, or Firm*—Frederick D. Poag

[57] ABSTRACT

A convergence unit for an in-line color cathode ray tube consists of two E-shaped cores, preferably formed of strip-shaped soft-magnetic material. Each E-core has two relatively long limbs extending from a central relatively short pole piece to end relatively short pole pieces windings extend around the limbs which are substantially parallel to a tangent to the neck of the CRT so that the magnetic fields due to individual turns reinforce the magnetic fields between the pole pieces.

Preferably each E-core has each of its two windings extending over both limbs, one being reverse wound, so that the mutual inductance between the two windings is zero.

8 Claims, 12 Drawing Figures

CONVERGENCE UNIT FOR IN-LINE COLOR CATHODE RAY TUBE

BACKGROUND OF THE INVENTION

1. Field of the Invention

This invention relates to a convergence unit for an in-line color cathode ray tube.

In an in-line color cathode ray tube, the "red", "green" and "blue" electron beams lie in a common plane as they travel down the neck of the cathode ray tube to the deflection yoke. For television, it is found that the so-called self-converging yokes are adequate to preserve color convergence at the CRT screen. However with high precision CRT's intended to display data, misconvergence of the CRT is readily apparent to the viewer and accordingly some means for converging the three beams must be provided. Clearly the convergence units used with the older delta-type cathode ray tubes are unsuitable due to the different relative positions of the three beams.

For in-line CRT's two different approaches have been proposed. In one approach, two 4-pole and two 6-pole magnetic fields are produced, for example, by means of a toroidal magnetic core surrounding the neck of the CRT and carrying a plurality of windings: the 4-pole field is used to produce horizontal and vertical shifting of the outer beams in opposite directions while the 6-pole field is used to produce horizontal and vertical shifting of the outer beams in the same direction. With this approach there is no or little shifting of the central, usually "green", electron beam.

In the other approach, exemplified by British Patent Specification No. 1,330,827, a pair of E-shaped cores is employed, one for influencing each outer beams. A vertical magnetic field component for horizontal shifting is produced between the outer legs or pole pieces of the E-core while a horizontal magnetic field component for vertical shifting is produced between the central leg or pole piece of the E-core and the two outer pole pieces. Shielding of the central electron beam from these magnetic fields is normally required as is disclosed in British Patent Specification 1,397,804 as well as in the aforementioned specification.

The co-pending U.S. Application No. (Ser. No. 454,399), of the same filing date and title as the present application, is concerned with an E-core approach which does not require shielding of the central beam. The present invention is concerned with a convergence unit using E-cores which is simpler to manufacture and which although requiring shielding of the central beam has a high efficiency. Thus the power required to converge dynamically the beams in low making it possible to use low cost integrated-circuit drive amplifiers.

SUMMARY OF THE INVENTION

According to the invention, a convergence unit for an in-line cathode ray tube comprises a pair of E-shaped magnetic cores each carrying a pair of independent windings by means of which a magnetic field is used to shift one or both of the outer beams of the cathode ray tube to correct for misconvergence and is characterized in that each E-shaped core has two limbs extending from a central pole piece to end pole pieces, the length of the limbs being larger than the lengths of the pole pieces and the windings being located around said limbs with the axis of each winding extending substantially parallel to a tangent to the cathode ray tube neck whereby magnetic fields due to individual turns reinforce the magnetic fields between the pole pieces.

BRIEF DESCRIPTION OF THE DRAWINGS

The invention will now be described, by way of example, with reference to the accompanying drawings in which.

DETAILED DESCRIPTION

Figure 1:
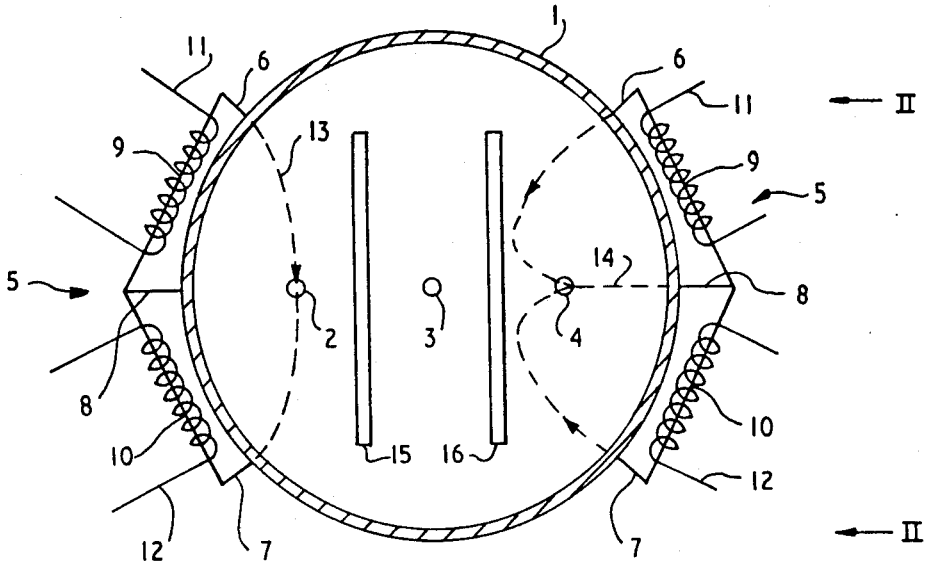
FIG. 1 is a sectional view of the neck of an in-line cathode ray tube showing the main elements of a convergence unit in accordance with the invention.

Referring now to FIG. 1, an in-line color cathode ray tube has a neck portion 1 within which are located the "red", "green" and "blue" electron beams 2, 3 and 4 respectively. In order to ensure correct beam convergence at the shadow mask and screen, not shown, it is necessary to be able to shift beams 2 and 4 vertically and/or horizontally with respect to the central beam 3. To this end, two E-cores 5 are provided, one on each side of the tube neck. Each E-core has end pole pieces 6 and 7 and a central pole piece 8 extending towards the neck 1 with limbs or arms 9 and 10 carrying windings 11 and 12 respectively.

By energizing the windings 11 and 12 in the same sense, a vertical field can be produced at the region of the outer beam as represented by field 13. By energizing the windings 11 and 12 in the opposite sense, a horizontal field can be produced at the region of the outer beam as represented by field 14. Fields 13 and 14 cause shifting of the outer beams in a horizontal and vertical directions respectively. Magnetic shields 15 and 16 shield the central electron beam 3 from the influence of the magnetic fields produced by means of the E-cores 5 and windings 11 and 12.

By driving the windings 11 and 12 with currents of the appropriate magnitude and direction, it can be ensured that the beams 2 and 4 are correctly positioned with respect to beam 3. Various analog and digital proposals have already been made as to how correction convergence currents can be generated in accordance with the position of the electron beams on the screen. These will not be described since they do not form a part of the present invention.

The efficiency (or sensitivity) of the convergence unit depends on a number of factors including the geometry and material of the E-cores, the design and position of the internal magnetic shields, the size of the windings and number of turns. In accordance with the invention, the E-cores 5 are formed with their limbs longer than their pole pieces with the windings extending along the limbs substantially parallel to a tangent to the neck. By so positioning the coils close to the tube by making the pole pieces 6, 7 and 8 very short compared to the pole pieces of the ferrite prior art E-cores where the coils are located on the pole pieces themselves, it can be ensured that the magnetic fields due to the individual turns reinforce the magnetic fields between the pole pieces. The length of the limbs 9 and 10 can be readily optimized for the particular cathode ray tube to be converged, particularly where strip-shaped soft-magnetic material such as permalloy and mumetal are used. In this case, it is preferred if the width of the strip extends parallel to the electron beam paths since this will increase the sensitivity.

The sensitivities for convergence correction are different at the center and in the corners of the screen. Horizontal correction is more sensitive in the corner and less sensitive in the center whereas vertical correction is less sensitive in the corners and more sensitive in the center. On the assumption that horizontal and vertical convergence errors are equally likely, then the best overall efficiency is achieved if the horizontal and vertical sensitivities are equal. (High sensitivity is achieved if the energy factor $LI^2$ is a minimum where L is the coil inductance and I the current required to shift the convergence by 1 mm). Since there should be no or little convergence error to correct at the center of the screen, the balance should be achieved in the corners by appropriate choice of the lengths of the links or arms 9 and 10 of the E-cores. Experimental results have shown that with a CRT neck outside diameter of 29 mm and beam separation of 7 mm an optimum balance can be achieved with limbs or arms 13 mm long. To increase the vertical sensitivity relative to the horizontal sensitivity, the arm lengths should be increased.

Table I below illustrates the horizontal and vertical correction energy factor (in microjoules/mm shift) for the center and corner areas of a CRT having the dimensions specified above.

TABLE I

| Arm Length (mm) | Correction Energy Factor ($LI^2$) | | | |
|---|---|---|---|---|
| | Center | | Corner | |
| | Horizontal | Vertical | Horizontal | Vertical |
| 15 | 8.5 | 1.2 | 3.5 | 2.3 |
| 13 | 5.0 | 1.5 | 2.6 | 2.6 |
| 10 | 1.8 | 5.0 | 0.9 | 9.0 |

Figure 2:
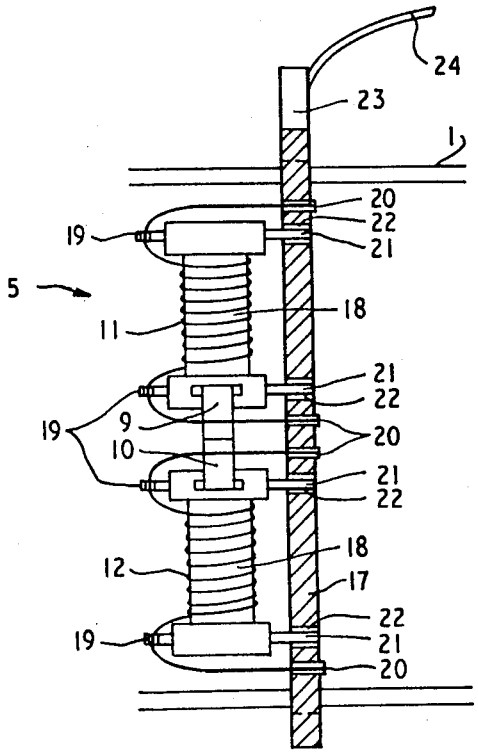
FIG. 2 shows how the E-cores of the convergence unit of FIG. 1 can be mounted on a printed circuit card surrounding the CRT neck.

FIG. 2, which is a part-sectional view in the Direction II—II, FIG. 1, illustrates how the E-cores 5 could be mounted on a printed circuit board 17 orthogonal to and surrounding the neck 1. Each coil 11, 12 is wound on a bobbin 18 of non-magnetic plastics material. Posts 19 allow the windings to be anchored to the bobbins 18 from which they can be led to apertures 20 in the circuit board 17. Each bobbin 18 has mounting posts 21 which mate with corresponding apertures 22 in the circuit board 17. As shown in the drawing, strip shaped arms or limbs 9 and 10 constituting the cores extend through bores within the bobbins 18. Printed wiring on the circuit board 17 leads to an edge connector 23 having a lead 24 by which current can be supplied to each of the four independent windings.

Figure 3:
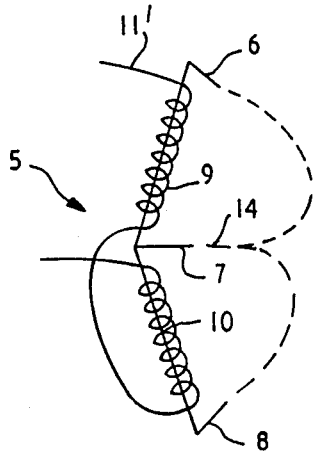
FIGS. 3 and 4 illustrate an alternative method of winding the E-cores.
Figure 4:
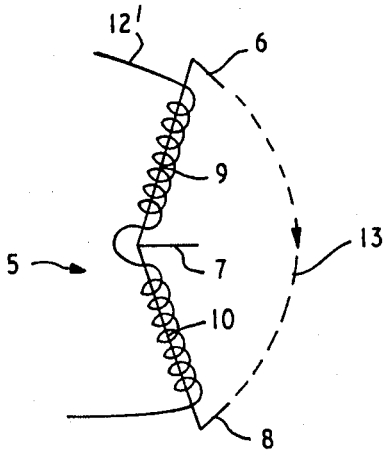

FIGS. 3 and 4 show an alternative arrangement for the E-core windings 11 and 12 shown in FIG. 1. As shown in FIG. 3, winding 11' is wound as two equal halves over both arms 9 and 10 of the E-core but is connected or wound to result in a horizontal field 14. Winding 12' is wound as two equal halves over both arms 9 and 10 and is connected or wound to result in a vertical field 13 as shown in FIG. 4. It will be appreciated that FIGS. 3 and 4 are shown separately to clarify the winding arrangement: in practice each E-core will consist of two windings 11' and 12'. Just as the embodiment of FIG. 1 can have the windings 11 and 12 wound directly on the mumetal E-core (in which case the limbs 9 and 10 can be curved to follow the tube envelope), so could the windings 11' and 12' in practice, be constituted by means of two double-wound bobbins connected via a printed circuit board as in FIG. 2. A significant advantage of the embodiment shown in FIGS. 3 and 4 is that with this windings arrangement, the mutual inductance between the two windings on each E-core is zero.

Figure 5:
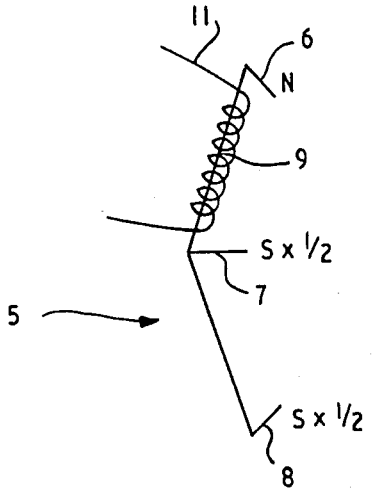
FIGS. 5 and 6 serve to illustrate a preferred winding arrangement for the coils shown in FIG. 1.
Figure 6:
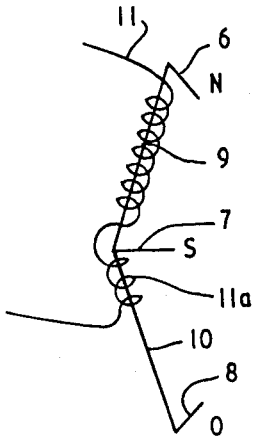

FIG. 5 serves to illustrate a problem which can arise with the arrangement of FIG. 1 where two independent coils are wound on different parts of the same E-core. If the coil 11 is energized as shown, then the pole adjacent to the unenergized part of the core will be spread out somewhat. To prevent this, a second coil **11*a* in series with the first coil 11 but wound in the opposite sense is provided on the lower part 10 of the E-core with half the number of turns of coil 11 as shown in FIG. 6**. This will have the effect of restricting the poles to the desired positions. As before the coils can be wound directly on the E-cores (in which case pre-formed ferrite material can be used) or a pair of prewound double wound bobbins could be used, one prewound winding being half the number of turns of the other.

Figure 7:
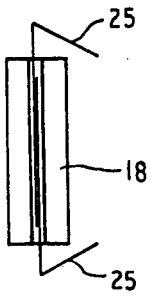
FIGS. 7, 8 and 9 illustrate how the windings may be wound on bobbins which are subsequently provided with core material.
Figure 8:
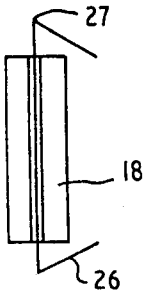
Figure 9:
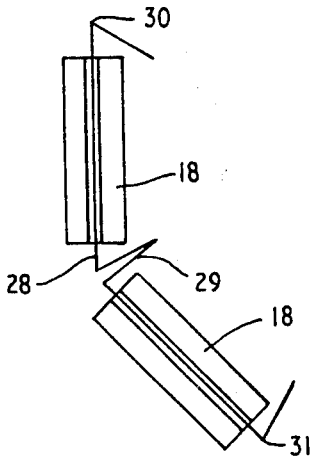

FIGS. 7 to 9 illustrate how prewound bobbins 18 may be provided with strip shaped core pieces. In FIG. 7, each bobbin 18 is supplied with a pair of L-shaped strips 25. Each E-core would consists of two such bobbin combinations located side by side. Since no bending is required,pre-formed ferrite core pieces could be used rather than mumetal strips. In FIG. 8, a single L-shaped core 26 is used which is bent at 27 after insertion in the bobbin 18: again two such bobbin combinations would be required to form an E-core. In FIG. 9, a single piece of strip shaped material 28 is first bent at 29 to form the eventual central pole piece of the E-core. After threading the bobbins 18 onto the strip 28, the strip is bent at 30 and 31 to form the end pole pieces.

Figure 10:
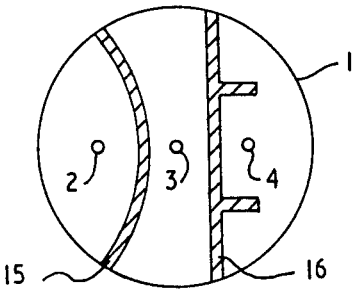
FIGS. 10, 11 and 12 show various forms of magnetic shielding for the central beam.
Figure 11:
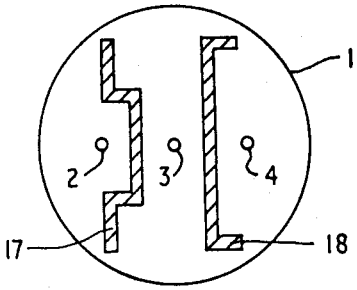
Figure 12:
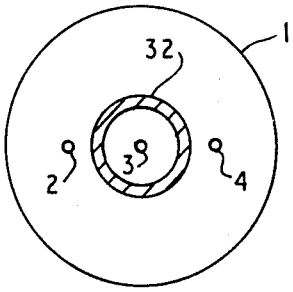

As was mentioned above, magnetic shielding is required to prevent shifting of the green beam. FIGS. 10 and 11 each show two different shapes for the magnetic shield plates 15, 16, 17 and 18. In practice the same shaped plates would be used on each side of the central beam 3. FIG. 12 shows an alternative arrangement in which the central beam 3 is completely surrounded by a shield 32: although a cylindrical shield is shown, any other convenient shape could be employed.

What has been described is a convergence unit for an inline color cathode ray tube having a pair of E-cores each with a pair of independent windings. Optimum sensitivity can be obtained by positioning the windings close to the tube with the fields due to the individual turns reinforcing the field between the pole pieces and selecting the lengths of the arms for the particular CRT employed.

What is claimed is:

1. A convergence unit for an in-line color cathode ray tube comprising a pair of E-shaped magnetic cores each carrying a pair of independent windings by means of which a magnetic field is used to shift one or both of the outer beams of the cathode ray tube to correct for misconvergence, characterized in that each E-shaped core has two limbs extending from a central pole piece to end pole pieces, the length of the limbs being significantly larger than the lengths of the pole pieces, and in that the windings are located around said limbs with the axis of each winding extending substantially parallel to a tangent to the cathode ray tube neck whereby magnetic fields due to individual turns reinforce the magnetic fields between the pole pieces, and in that each winding extends over more than one limb.

2. A convergence unit as claimed in claim 1, characterized in that each winding is wound equally over both limbs of each E-core, one winding on each E-core being arranged so that the magnetic fields due to its parts on the two limbs oppose one another and the other winding on each E-core being arranged so that the magnetic fields due to its parts on the two limbs support one another, the mutual inductance between the windings on each E-core being substantially zero.

3. A convergence unit as claimed in claim 1, in which each winding is wound with its main part on one limb and with a part wound on the other limb so as to restrict the magnetic poles to the center pole piece and one of the end pole pieces when only one winding is energized.

4. A convergence unit as claimed in claim 1, 2 or 3, wherein each E-shaped core is formed from strip-shaped soft-magnetic material having its width extending parallel to the beam direction.

5. A convergence unit as claimed in claim 1, 2 or 3, wherein each E-core comprises a pair of pre-wound bobbins mounted on a printed circuit board surrounding the neck of said cathode ray tube, said strip-shaped material being located within a bore extending through each bobbin.

6. A convergence unit as claimed in claim 5, in which each bobbin is provided with two pre-wound windings.

7. A convergence unit as claimed in claim 1, 2 or 3, in which the length of each limb is selected to equalize the horizontal and vertical sensitivities at the corner of the screen of the cathode ray tube.

8. A convergence unit for an in-line color cathode ray tube comprising a pair of E-shaped magnetic cores each carrying a pair of independent windings by means of which a magnetic field is used to shift one or both of the outer beams of the cathode ray tube to correct for misconvergence, characterized in that each E-shaped core has two limbs extending from a central pole piece to end pole pieces, the length of the limbs being significantly larger than the lengths of the pole pieces, and in that the windings are located around said limbs with the axis of each winding extending substantially parallel to a tangent to the cathode ray tube neck whereby magnetic fields due to individual turns reinforce the magnetic fields between the pole pieces, and in that the length of each limb is selected to equalize the horizontal and vertical sensitivities at the corner of the screen of the cathode ray tube.

* * * * *